US007690424B2

(12) United States Patent
McLeod et al.

(10) Patent No.: US 7,690,424 B2
(45) Date of Patent: Apr. 6, 2010

(54) WELL BORE ANCHORS

(75) Inventors: Iain McLeod, Newmachar (GB); Steve Reid, Aberdeen (GB)

(73) Assignee: Petrowell Limited (GB)

( * ) Notice: Subject to any disclaimer, the term of this patent is extended or adjusted under 35 U.S.C. 154(b) by 0 days.

(21) Appl. No.: 11/816,421

(22) PCT Filed: Oct. 7, 2005

(86) PCT No.: PCT/GB2005/003871

§ 371 (c)(1),
(2), (4) Date: Mar. 31, 2008

(87) PCT Pub. No.: WO2006/092545

PCT Pub. Date: Sep. 8, 2006

(65) Prior Publication Data

US 2009/0014173 A1 Jan. 15, 2009

(30) Foreign Application Priority Data

Mar. 4, 2005 (GB) ..... 0504471.4

(51) Int. Cl.
*E21B 23/01* (2006.01)

(52) U.S. Cl. ..... 166/134; 166/217

(58) Field of Classification Search ..... 166/134, 166/382, 206, 217, 120
See application file for complete search history.

(56) References Cited

U.S. PATENT DOCUMENTS 2,546,377 A * 3/1951 Turechek ..... 166/196
3,066,738 A * 12/1962 Myers ..... 166/149
3,167,127 A * 1/1965 Sizer ..... 166/120
3,167,128 A 1/1965 Sutliff
3,623,551 A * 11/1971 Randermann, Jr. ..... 166/134
3,889,750 A 6/1975 Mullins
4,317,485 A 3/1982 Ross
4,917,187 A 4/1990 Burns et al.
6,062,309 A 5/2000 Gosse

FOREIGN PATENT DOCUMENTS

GB 755082 8/1956
GB 2245624 8/1992

OTHER PUBLICATIONS

International Search Report.
UKIPO Office Action in priority case examination.
Written Opinion of the International Searching Authority.

* cited by examiner

*Primary Examiner*—Hoang Dang
(74) *Attorney, Agent, or Firm*—Stephen M. Nipper; Dykas, Shaver & Nipper, LLP

(57) ABSTRACT

A formation engaging member for use in an open hole anchor (10) is described. The formation engaging member has at least one first open hole surface engaging element (20) for penetrating a surface of an open hole, and at least one second open hole surface engaging element (22) for fractionally interacting with a surface of the open hole to form an interference engagement. A method of anchoring to a formation surface of an open hole and an anchor are also described.

30 Claims, 7 Drawing Sheets

SET

WELL BORE ANCHORS

The present invention relates to well bore anchors and particularly to anchors for in an open hole.

When a well bore is drilled, it is sometimes necessary to provide an anchor in the "open hole" to permit various downhole operations to be performed. By "open hole" it is meant the unlined or uncased well bore.

Care must be taken during anchoring in an open hole to avoid causing excessive damage to the formation surface, because if the rock becomes overstressed it can fracture, potentially increasing the bore of the hole and thereby increasing the difficulty of providing an acceptable anchor.

Conventional anchors for packing-off open hole well bores utilise a rubber inflatable element, which engages the rock surface and relies on seal friction to provide the anchor. The inflatable element is generally inflated with well fluid or cement.

Inflatable anchors, however, have associated drawbacks. Particularly, they can be unreliable when an axial load is applied, as the load can cause the anchor to move, which, in turn, can cause damage to the rubber. In extreme cases, damage to the rubber can permit a liquid inflation medium to leak out of the inflatable element.

Furthermore, if cement is used as the inflation medium, care has to be taken to ensure the effect of cement shrinkage as the cement sets is taken into account during inflation.

Conventional cased or lined bore anchors have been found to be unsuitable for open hole anchoring because of the damage caused to the surface of the open hole.

It is an object of the present invention to obviate or mitigate at least one of the aforementioned disadvantages.

According to a first aspect of the present invention there is provided a formation engaging member for use in an open hole anchor, the formation engaging member comprising:

at least one first open hole surface engaging element for penetrating a surface of an open hole, and at least one second open hole surface engaging element for frictionally interacting with a surface of the open hole to form an interference engagement with the formation surface.

The provision of a combination of first and second engaging elements, the first of which penetrates the formation surface and second of which forms an interference with the formation surface allows, when in use with an anchoring apparatus, the formation engaging member to anchor the apparatus to the formation surface of an open hole without overstressing the formation, which could cause the rock to fracture.

In this case a "formation surface" is any geological surface such as the surface of a bore hole and "penetrate" means that the formation surface is pierced. When engaged, the first open hole surface engaging element bites the formation surface.

Preferably, the formation engaging member is a slip.

Slips are widely used on conventional anchors for cased or lined bores. By providing the present invention in the form of a slip, a conventional, mandrel set, cased or lined bore anchor housing can be used to actuate and anchor the slips to the open hole surface. Using such a conventional cased bore anchor housing has the added advantage that axial loads applied subsequently to the mandrel are not transmitted to the formation engaging member.

The slip provided by the present invention has the desirable result of providing an anchor suitable for anchoring to the rock surface whilst causing minimal damage to the formation.

The slip may be adapted to be expanded into contact with an open hole. The slip may be expanded by a wedge profile. Alternatively, the slip may be adapted to be expanded by hydraulic or hydrostatic pressure. In a further alternative, well pressure can be used to set the slip. In a still further alternative, a cantilever arrangement for engaging the member may be employed.

Preferably, there is a plurality of first engaging elements.

Preferably, there is a plurality of second engaging elements.

Preferably, the at least one first and second engaging elements are arranged in parallel rows. The parallel rows may be arranged transversely to the longitudinal axis of the expandable member. Alternatively, the arrangement of first and second elements may be positioned based on the formation surface to be engaged.

The at least one first and second engaging elements is may comprise rows of teeth. The at least one first engaging element may comprise at least one row of relatively sharp teeth and the at least one second engaging element may comprise at least one row of relatively blunt teeth. Preferably, the blunt teeth have an abrasive surface or any surface suitable for providing a localized increase in friction when engaged with a formation. Preferably, the abrasive surface is a knurled surface.

Discrete teeth, rather than a continuous surface, are used to regulate the pressure applied to the surface through the formation engaging member. The sharp teeth of the first engaging element(s) maximises the pressure applied to the formation, as the force is channelled through a relatively small contact area, enabling the teeth to penetrate the formation. The blunt teeth of the second engaging element(s) have an increased contact area through which to channel the setting force, resulting in a lower pressure being applied to the formation, thereby ensuring the formation is gripped rather than pierced.

The at least one first and at least one second engaging elements may extend from a surface of the formation engaging member, the at least one first engaging element extending beyond the at least one second engaging element.

In one embodiment there are two rows of first engaging elements, the two rows of first engaging elements being located substantially centrally on the formation engaging member, with respect to the longitudinal axis of the formation engaging member.

The at least one formation engaging member may be metal. In one embodiment, the at least one formation engaging member may be mild steel. In an alternative embodiment the at least one formation engaging member may be tungsten carbide. Alternatively, any suitable material such as a composite may be used for the at least one formation engaging member.

Metal is a particularly suitable material for the formation engaging members because it lends itself to machining. Up to three formation engaging members can be machined from a suitably dimensioned section of metal tubing. The metal chosen will depend on the surface to be anchored to, the metal chosen always being harder than the rock. For example, for a sandstone formation, a mild steel expandable member is suitable. For particularly hard rock, a tungsten carbide expandable member is suitable.

According to a second aspect of the present invention there is provided a method of anchoring to a formation surface of an open hole, the method comprising the steps of:

energising at least one formation engaging member from a run-in position to a set position;

applying a load to the at least one formation engaging member in the set position to cause set formation engaging member to penetrate the formation surface by means of at least one first open hole surface engaging element; and frictionally engaging at least one second open hole surface engaging element with the formation surface to form an interference engagement with irregularities on the formation surface.

According to a third aspect of the present invention there is provided an anchor for anchoring to a surface of an open hole, the anchor comprising:

a housing;

at least one formation engaging member moveably secured to the housing, the at least one formation engaging member having at least one first open hole surface engaging element adapted to penetrate a surface of an open hole and at least one second open hole surface engaging element adapted to frictionally interact with a surface of the open hole to form an interference engagement with the formation surface.

Preferably, the anchor further comprises integral energising means adapted to move the at least one formation engaging member between a run-in position and an engaged position. The energising means may be a hydraulic piston. Alternatively, the energising means may be separate from the housing. In this case the anchor may be energised by a separate setting tool which engages and actuates the anchor. In a further alternative, the anchor may be set hydraulically with swab cups on a wash pipe below a running tool, or by a hydraulically triggered hydrostatic chamber. The man of ordinary skill in the art will understand any suitable electric, hydraulic, pyrotechnic, mechanical or other actuator, or electrical deployment technique, could be employed to set the anchor.

Preferably, there is a plurality of formation engaging members. Most preferably, there are three or more formation engaging members. Where there are three formation engaging members, or three pairs of formation engaging members, equi-spaced around the anchor, the anchor is suitable for anchoring in open holes that are out-of-round. Out-of-round holes, or holes of non-circular cross-section, can occur during drilling through rock, particularly if there is drill pipe wear.

In use, a setting force applied to the anchor establishes a setting force between the formation engaging member and the rock, permitting the formation engaging member to be anchored with minimal penetration of the formation, but sufficient force to prevent axial movement of the formation engaging member.

Such an anchor can be used to anchor a packer, including inflatable or swell packers to prevent axial movement, a straddle, a liner tensioner, a whipstock or a plug in an open hole or any downhole device required to be anchored in an open hole.

According to a fourth aspect of the present invention, there is provided an engaging member for use in non-metallic casing, the engaging member comprising:

at least one first casing surface engaging element for penetrating a surface of the casing, and at least one casing surface engaging element for frictionally interacting with a surface of the casing to form an interference engagement with the casing surface.

By virtue of the present invention an anchor for an open hole which provides stable anchoring with minimal damage to the formation.

The present invention will now be described, by way of example, with reference to the accompanying figures in which.

Figure 1:
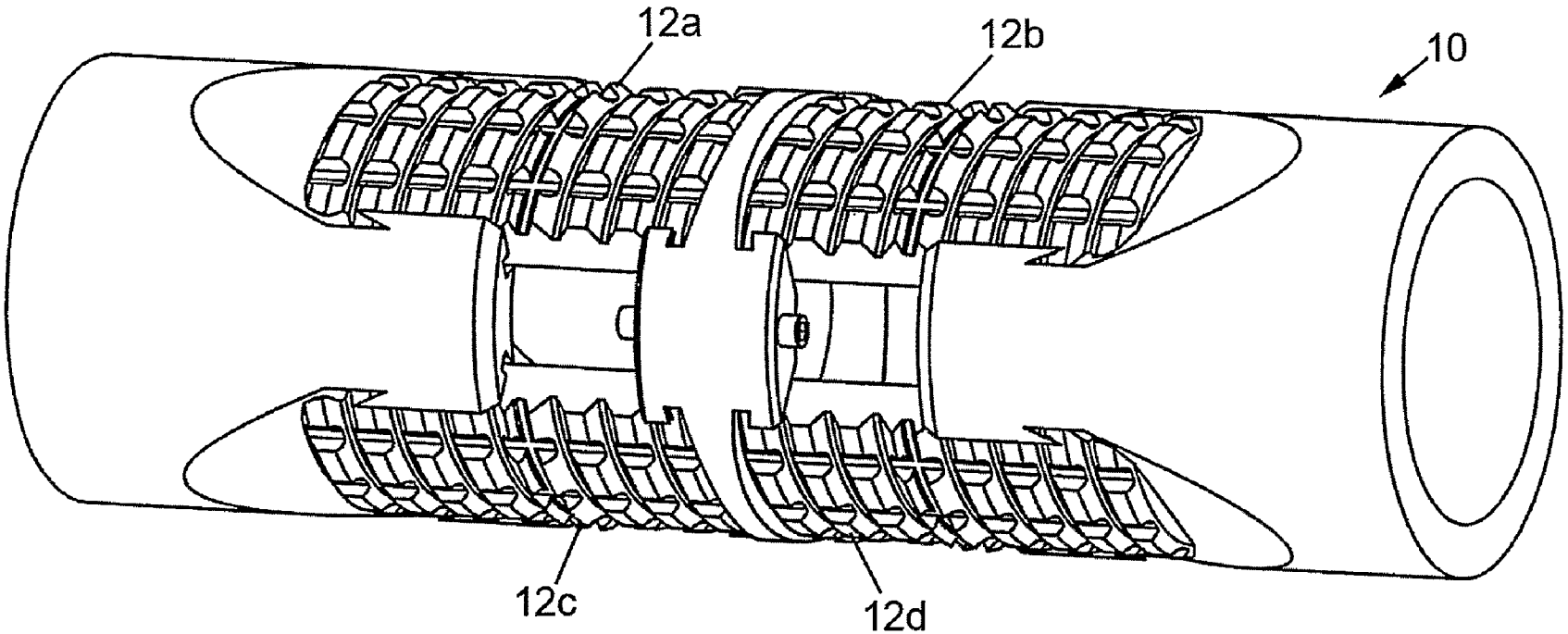
FIG. 1 is perspective view of an open hole anchor in a run-in configuration incorporating slips in accordance with a first embodiment of the present invention.

Referring firstly to FIG. 1, there is shown a perspective view of an open hole anchor generally indicated by reference numeral 10 incorporating six slips 12 of which four 12*a* to 12*d* are visible, in accordance with a first embodiment of the present invention.

Figure 2:
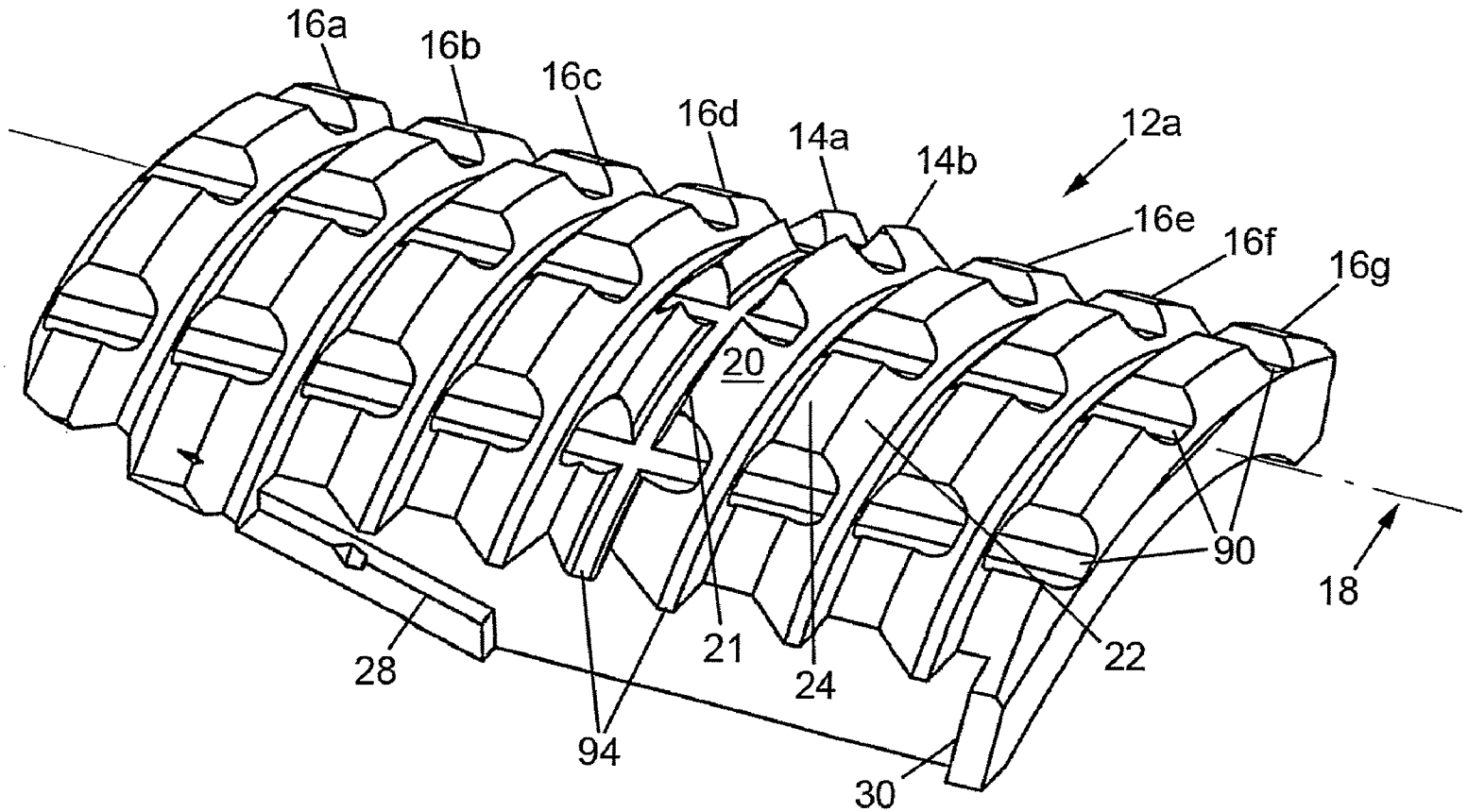
FIG. 2 is an enlarged perspective view one of the slips shown on the open hole anchor of FIG. 1.

The first slip 12*a* can be seen more clearly in FIG. 2, an enlarged perspective view of one of the slips 12 shown on the open hole anchor 10 of FIG. 1. The slip 12*a* has two rows 14*a*, 14*b* of penetrating teeth 20 for penetrating, or breaking, a formation surface (not shown) and seven rows 16*a* to 16*g* of gripping teeth 22 adapted to interact with the formation surface to form an interference.

Each of the penetrating teeth 20 defines a relatively sharp ridge 21. A sharp ridge 21 minimises the surface area through which a setting force is applied to the formation, thereby maximising the pressure applied to the formation, with the result that the formation is penetrated by the teeth 20.

Each of the gripping teeth 22, however, defines a knurled upper surface 24 with a greater surface area than the penetrating teeth 20, resulting in a lower pressure being applied to the formation, for a given setting force, than for the penetrating teeth 20, with the result that friction is established between the formation and the gripping teeth, and the formation is gripped by gripping teeth 22, rather than penetrated. The knurled surface 24 forms an interference engagement the formation surface The first and second rows of teeth 14, 16 are arranged in parallel rows, transverse to the longitudinal axis 18 of the slip 12*a*.

The slip 12*a* also includes a first guide surface 28 and a second guide surface 30, the purpose of which will be discussed in connection with FIGS. 5-8.

Figure 3:
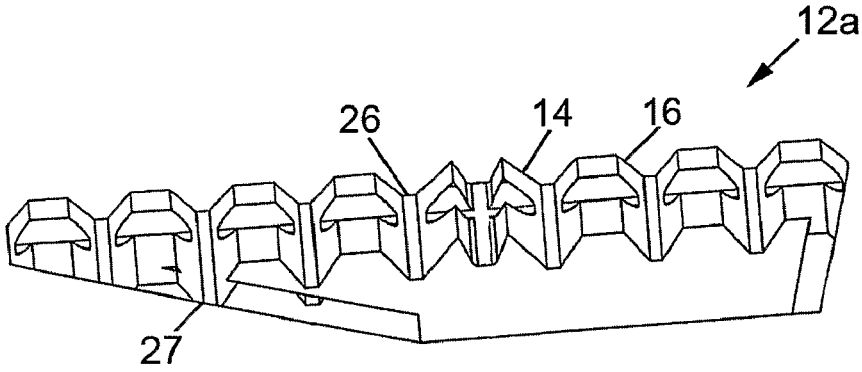
FIG. 3 is a side view of the slip of FIG. 2.

Referring now to FIG. 3, a side view of the slip of FIG. 2, it can be seen the first and second rows of teeth 14,16 extend from an upper surface 26 of the slip 12*a*. The height of the sharp teeth 20 is greater than that of the blunt teeth 22, with the result, in use, the sharp teeth 20 will penetrate the formation surface before the gripping teeth 22 engage the formation surface. The action of the gripping teeth 22 engaging the formation prevents the penetrating teeth 20 from penetrating too far into the formation and possibly causing part of the surface to fracture and break away from the formation.

As can be seen from FIG. 3, the slip also includes a cam surface 27, the purpose of which will be discussed in connection with FIGS. 5-8.

Figure 4:
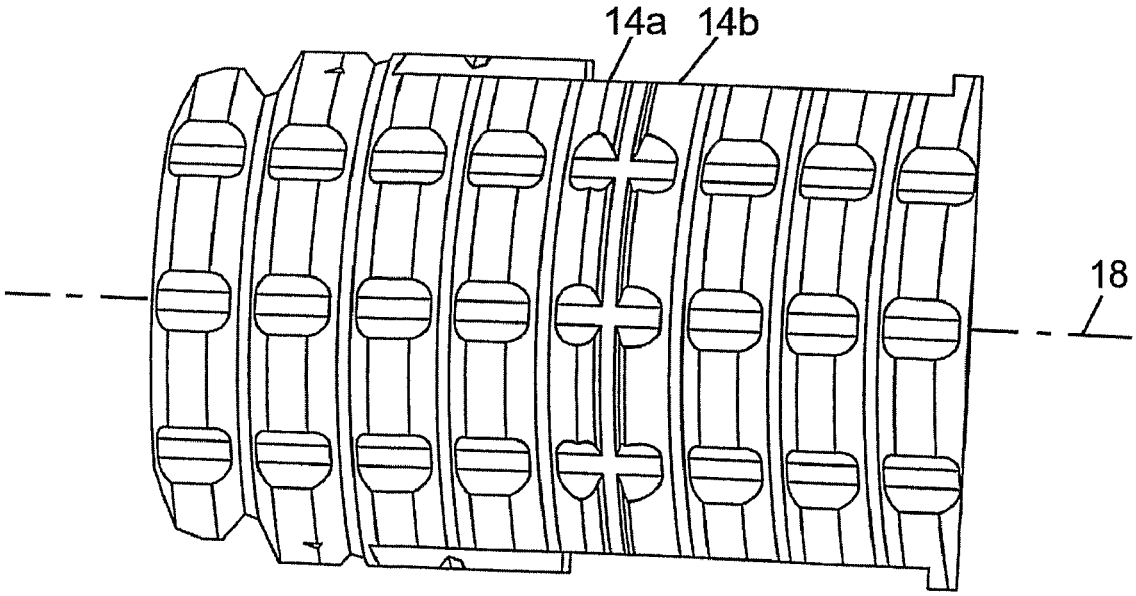
FIG. 4 is a top view of the slip of FIG. 2.

As can be seen from FIG. 4, the rows 14 of penetrating teeth 20 are located relatively centrally on the slip 12*a* with respect to the longitudinal axis 18.

Figure 5:
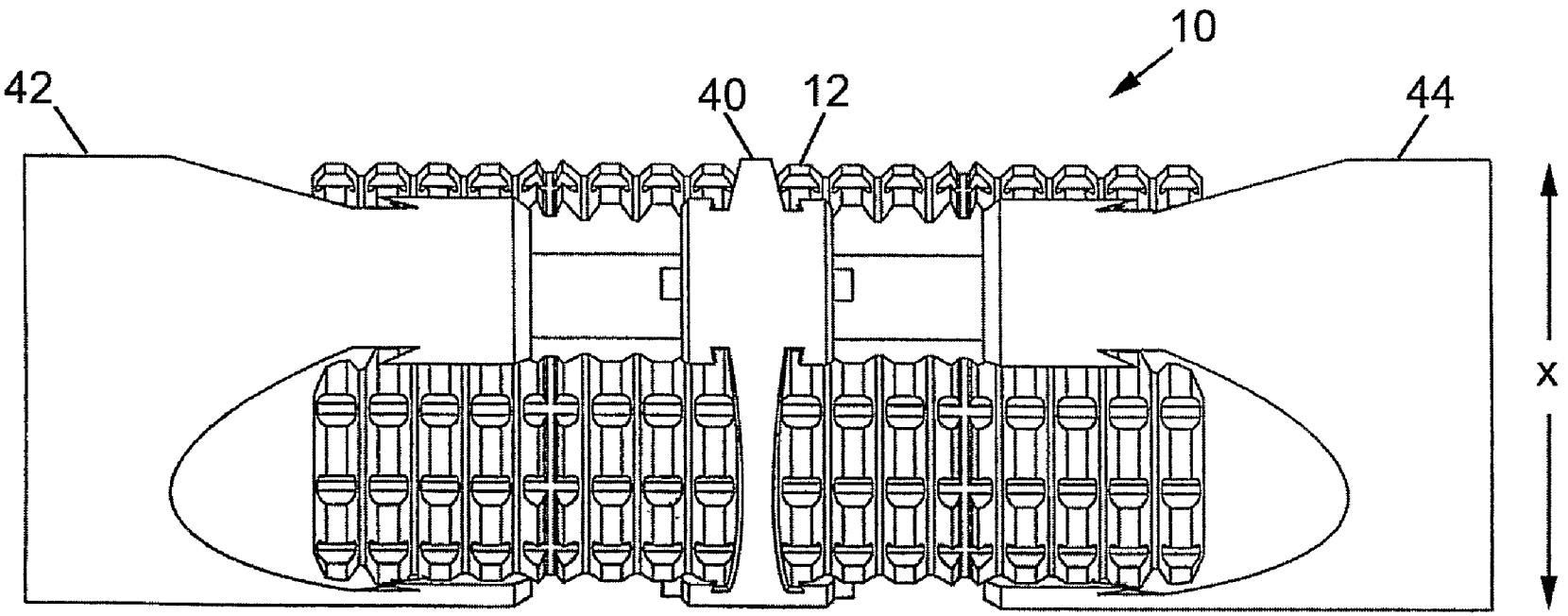
FIG. 5 is a side view of the open hole anchor of FIG. 1 in the run-in configuration.

FIG. 5 is a side view of the open hole anchor 10 of FIG. 1 in the run-in configuration.

The anchor 10 includes a central housing 40, a first end housing 42 and a second end housing 44. In this configuration, the slips 12 are withdrawn into the anchor 10 so that they do not extend beyond the diameter "X" defined by the anchor 10. This is the "run-in" configuration.

Figure 6:
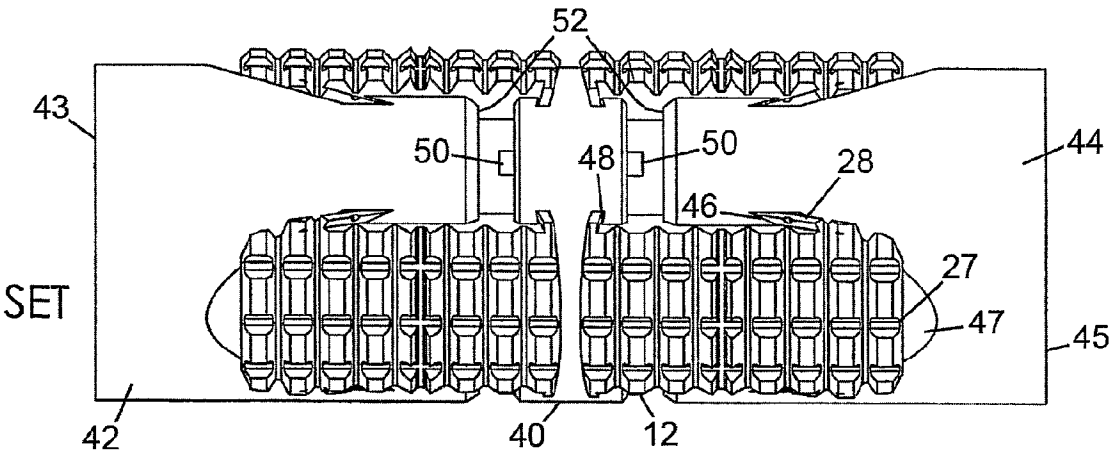
FIG. 6 is a side view of the open hole anchor of FIG. 1 in a set configuration.
Figure 8:
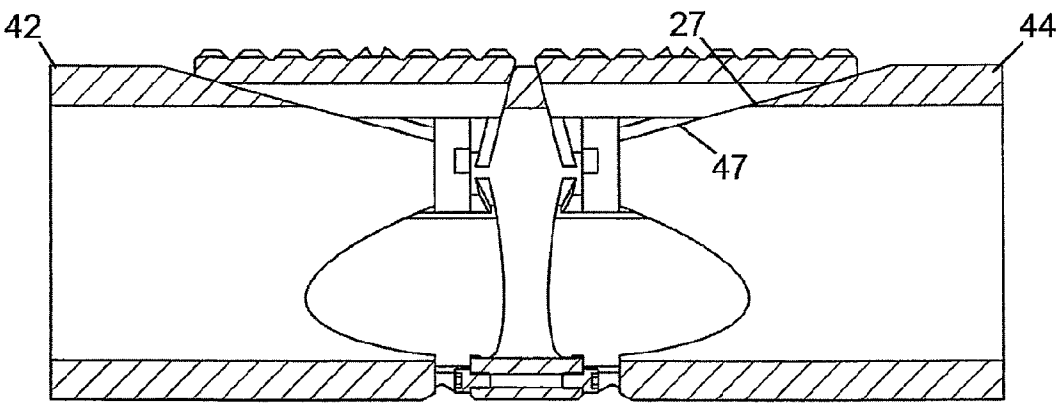
FIG. 8 is a sectional view through line A-A on FIG. 7.
Figure 7:
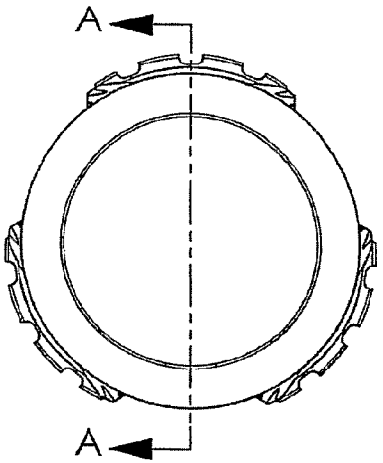
FIG. 7 is an end view of the open hole anchor of FIG. 6.

Referring now to FIGS. 6-8, various views of the open hole anchor 10 in a set configuration are shown. In the following description, the operation of one of the slips is described. It will be understood the description of FIGS. 6-8 applies equally to the operation of all slips of the open hole anchor.

In the set configuration, the first and second end housings 42, 44, have been displaced from the position shown in FIG. 5, towards the central housing 40. This displacement is achieved by first and second hydraulically controlled pistons (not shown) acting on the respective end surface 43, 45 of the first and second end housings. The displacement of the first and second end housings 42,44 is trapped by a ratchet device (not shown for clarity), maintaining the slips 12 in the set configuration.

In the embodiments shown in FIGS. 6 to 8, as the first and second end housings 42, 44 move towards the central housing 40, the slip cam surface 27 engages and interacts with a complementary end housing cam surface 47 to urge the slip 27 radially outwards from the anchor 10. The slip guide surfaces 28, 30 are constrained in housing channels 46, 48 defined by the end housing and the central housing 40 respectively. This arrangement ensures controls movement of each of the six slips 12 towards the formation in a consistent manner.

The central housing 40 includes stops 50 which restrict the movement of the end housings 42, 44 towards the central housing 40. The maximum achievable in-use expansion of the slips 12 from the anchor 10 occurs when the forward surface 52 of the end housing 50 engages one of the stops 50, that is at the point of maximum displacement of the end housing 42, 44 towards the central housing 40.

To assemble the anchor 10, the end housings 42, 44 are brought into contact with the central housing 40, with the stops 50 removed. In this position the slips 12 can be connected to the housing such that the end and central housing channels 46,48 are engaged with the first and second guide surfaces 28, 30. As the end housings 42, 44 are moved apart, the slips 12 will be withdrawn into the tool 10 by the end and central housing channels 46, 48 acting on the first and second guide surfaces 28, 30. Once the slips 12 are withdrawn into the tool, the stops 50 can be replaced.

Figure 9:
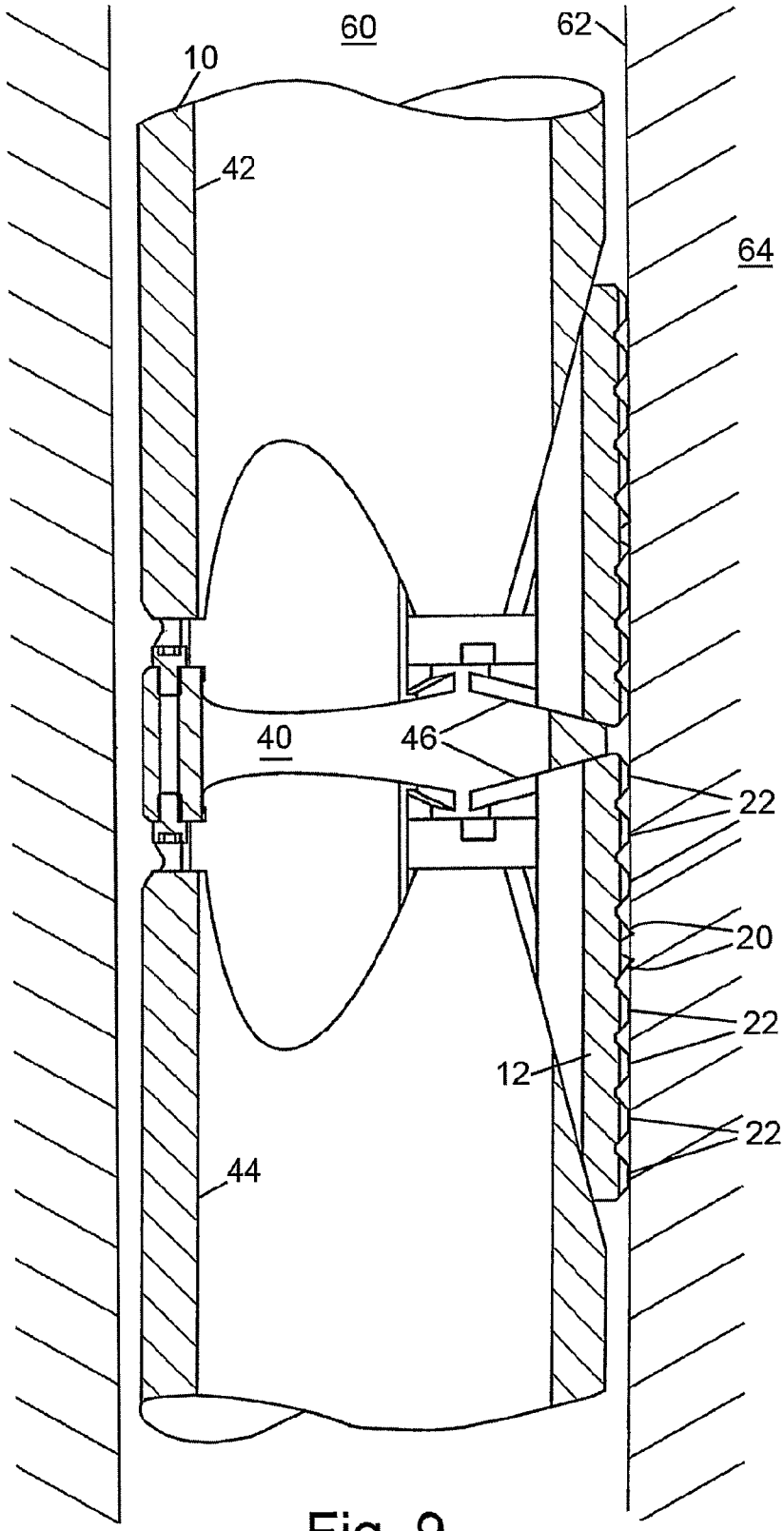
FIG. 9 is an enlarged sectional view of the anchor of FIG. 7 taken on the line A-A when anchored in an open hole.

Referring to FIG. 9, there is shown an enlarged sectional view of the anchor 10 of FIG. 7 taken on the line A-A when anchored in an open hole 60. As can be seen, the open hole has a surface 62, and the anchor 10 has been run-in by a mandrel (not shown).

The slips 12 are shown engaged with the surface 62 of the formation 64. The penetrating teeth 20 have penetrated the formation surface 62 and the gripping teeth 22 have engaged but not penetrated the formation surface 62. It will be understood that the formation surface 62 will not be perfectly smooth, and the degree of interference between teeth 22 and the formation surface 62 will vary, but there will always be some friction between the teeth 22 and the formation surface 62.

Figure 10:
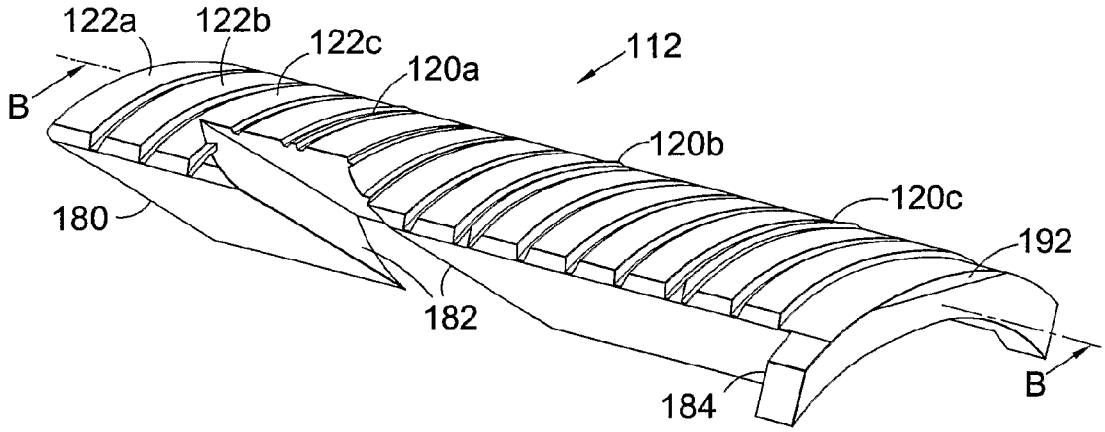
FIG. 10 is a perspective view of an open hole anchor slip in accordance with a second embodiment of the present invention.
Figure 11:
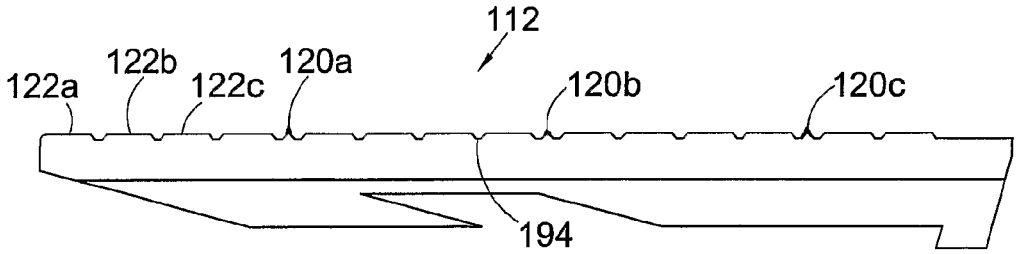
FIG. 11 is a cross-sectional side view through line B-B of FIG. 10.

FIGS. 9 and 10 show perspective and cross-sectional side views of an open hole anchor slip, generally indicated by reference numeral 112, in accordance with a second embodiment of the present invention.

The slip 112 is specifically designed for softer formations than the slip 12, and is of slightly greater length than slip 12 to spread the load over a greater area. When the slip 112 is one of a set of six slips used on a tool, the slips 122 can be arranged differently to the arrangement shown in the tool 10 of FIG. 1 to further spread the applied stresses to different parts of the formation. The tool 10 of FIG. 1 has two sets of three slips 12 arranged in pairs spaced equally around the tool. In the alternative arrangement the second set of slips could be offset 60° from the first set.

The slip 112 has three penetrating teeth 120A-120C for penetrating, or breaking, a formation surface (not shown), and fourteen rows 122 of gripping teeth adapted to interact with the formation surface to form an interference. For clarity, only three of the rows "122A", "122B" and "122C" are indicated.

It will be noted, in contrast to the slip 12 of the first embodiment, each penetrating tooth 120 does not comprise a number of discrete teeth, rather a single tooth. The absence of the axial grooves 90 between the teeth, which divided the teeth of FIG. 2, assists in preventing the slip 122, in use, from digging into the formation when attached to a tool, as the tool is lifted by the slips 112 into position. The inclusion of a chamfer 192 on slip 112 also assists in preventing the slip 112 from digging into the formation as the tool is lifted.

It will also be noted that the radial groove 194 between each adjacent tooth 120, 122 is shallower than the corresponding radial grooves 94 of the slip 12 (shown in FIG. 2). In use, the grooves 194, 94 fill with crumbled formation, and the shallower the groove 194, 94, the quicker it will fill with crumbled formation, with the result that the maximum contact area between the formation and the slip 112 is achieved sooner than is the case with a deeper groove.

The slip 112 includes three guide surface, 180, 182 and 184 for expanding the slip 112 into formation engagement which are designed to spread the stresses generated by axial loading.

Various modifications may be made to the embodiment described without departing from the scope of the invention. For example, any suitable means of setting the slips could be employed including setting hydraulically with swab cups on a wash pipe below a running tool, or by a hydraulically triggered hydrostatic chamber. Any suitable industry standard setting tool can be used to set the slips.

Those of skill in the art will recognise that the above described embodiment of the invention provides an anchor through an open hole which provides stable anchoring with minimal damage to the formation.

The invention claimed is:

1. A formation engaging member for use in an open hole anchor, the formation engaging member comprising:

at least one first open hole surface engaging element for penetrating a surface of an open hole, wherein the at least one first engaging element comprises rows of teeth, and wherein the at least one first engaging element comprises at least one row of relatively sharp teeth, and at least one second open hole surface engaging element for frictionally interacting with a surface of the open hole to form an interference engagement with the formation surface, wherein the at least one second engaging element comprises rows of teeth, and wherein the at least one second engaging element comprises at least one row of relatively blunt teeth, wherein the formation engaging member further defines at least one groove separating adjacent open hole surface engaging elements, and wherein the blunt teeth have an abrasive surface or any surface suitable for providing a localized increase in friction when engaged with a formation.

2. The formation engaging member of claim 1, wherein the formation engaging member is a slip.

3. The formation engaging member of claim 2, wherein the slip is adapted to be expanded into contact with an open hole.

4. The formation engaging member of claim 3, wherein the slip is expanded by a wedge profile.

5. The formation engaging member of claim 3, wherein the slip is adapted to be expanded by hydraulic or hydrostatic pressure.

6. The formation engaging member of claim 3, wherein the slip is adapted to be expanded by well pressure.

7. The formation engaging member of claim 3, wherein the slip is adapted to be expanded by a cantilever arrangement.

8. The formation engaging member of claim 1, wherein the member comprises a plurality of first engaging elements.

9. The formation engaging member of claim 1, wherein the member comprises a plurality of second engaging elements.

10. The formation engaging member of claim 1, wherein the at least one first and second engaging elements are arranged in parallel rows.

11. The formation engaging member of claim 10, wherein the parallel rows may be arranged transversely to the longitudinal axis of the expandable member.

12. The formation engaging member of claim 1, wherein the abrasive surface is a knurled surface.

13. The formation engaging member of claim 1, wherein the at least one first and at least one second engaging elements extend from a surface of the formation engaging member, the at least one first engaging element extending beyond the at least one second engaging element.

14. The formation engaging member of claim 1, wherein there are two rows of first engaging elements, the two rows of first engaging elements being located substantially centrally on the formation engaging member with respect to the longitudinal axis of the formation engaging member.

15. The formation engaging member of claim 1, wherein the at least one formation engaging member is metal.

16. A formation engaging member for use in an open hole anchor, the formation engaging member comprising:

at least one first open hole surface engaging element for penetrating a surface of an open hole, wherein the at least one first engaging element comprises rows of teeth, and wherein the at least one first engaging element comprises at least one row of relatively sharp teeth, and at least one second open hole surface engaging element for frictionally interacting with a surface of the open hole to form an interference engagement with the formation surface, wherein the at least one second engaging element comprises rows of teeth, and wherein the at least one second engaging element comprises at least one row of relatively blunt teeth, wherein the formation engaging member further defines at least one groove separating adjacent open hole surface engaging elements, and wherein the at least one first and at least one second engaging elements extend from a surface of the formation engaging member, the at least one first engaging element extending beyond the at least one second engaging element.

17. The formation engaging member of claim 16, wherein the formation engaging member is a slip.

18. The formation engaging member of claim 16, wherein the slip is adapted to be expanded into contact with an open hole.

19. The formation engaging member of claim 18, wherein the slip is expanded by a wedge profile.

20. The formation engaging member of claim 18, wherein the slip is adapted to be expanded by hydraulic or hydrostatic pressure.

21. The formation engaging member of claim 18, wherein the slip is adapted to be expanded by well pressure.

22. The formation engaging member of claim 18, wherein the slip is adapted to be expanded by a cantilever arrangement.

23. The formation engaging member of claim 16, wherein the member comprises a plurality of first engaging elements.

24. The formation engaging member of claim 16, wherein the member comprises a plurality of second engaging elements.

25. The formation engaging member of claim 16, wherein the at least one first and second engaging elements are arranged in parallel rows.

26. The formation engaging member of claim 25, wherein the parallel rows may be arranged transversely to the longitudinal axis of the expandable member.

27. The formation engaging member of claim 16 wherein the blunt teeth have an abrasive surface or any surface suitable for providing a localized increase in friction when engaged with a formation.

28. The formation engaging member of claim 27, wherein the abrasive surface is a knurled surface.

29. The formation engaging member of claim 16, wherein there are two rows of first engaging elements, the two rows of first engaging elements being located substantially centrally on the formation engaging member with respect to the longitudinal axis of the formation engaging member.

30. The formation engaging member of claim 16, wherein the at least one formation engaging member is metal.

* * * * *